US011089410B2

(12) United States Patent
Fischer et al.

(10) Patent No.: US 11,089,410 B2
(45) Date of Patent: Aug. 10, 2021

(54) METHOD FOR DIRECTIONAL SIGNAL PROCESSING FOR A HEARING AID

(71) Applicant: SIVANTOS PTE. LTD., Singapore (SG)

(72) Inventors: Eghart Fischer, Schwabach (DE); Homayoun Kamkar-Parsi, Erlangen (DE); Jens Hain, Kleinsendelbach (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/988,855

(22) Filed: Aug. 10, 2020

(65) Prior Publication Data

US 2021/0044908 A1 Feb. 11, 2021

(30) Foreign Application Priority Data

Aug. 8, 2019 (DE) ..... 102019211943

(51) Int. Cl.
*H04R 25/00* (2006.01)

(52) U.S. Cl.
CPC ..... *H04R 25/405* (2013.01); *H04R 25/45* (2013.01)

(58) Field of Classification Search
CPC ..... H04R 25/40; H04R 25/45; H04R 25/405; H04R 25/407
See application file for complete search history.

(56) References Cited

U.S. PATENT DOCUMENTS 7,212,642 B2 5/2007 Rasmussen
8,526,647 B2 9/2013 Pedersen et al.
(Continued)

FOREIGN PATENT DOCUMENTS

DE 102017206788 B3 8/2018
DE 102017215823 B3 9/2018
(Continued)

OTHER PUBLICATIONS

Arthur Fox: "What Is a Subcardioid/Wide Cardioid Microphone? (With Mic Examples) My New Microphone", Sep. 30, 2018, (Sep. 30, 2018), XP055747039, [found on the Internet Nov. 4, 2020: URL:https://mynewmicrophone.com/what-is-a- subcardioid-wide-cardioid-microphone-with- mic-examples/ p. 3-p. 8.

*Primary Examiner* — Mark Fischer
(74) *Attorney, Agent, or Firm* — Laurence A. Greenberg; Werner H. Stemer; Ralph E. Locher

(57) ABSTRACT

A method for directional signal processing for a hearing aid. First and second input transducers generate first and second input signals from an ambient acoustic signal. A forward signal and a backward signal are generated from the first and second input signals and a first directional parameter is determined as a linear factor of a linear combination of the forward and backward signals. The first directional signal has a maximum attenuation in a first direction. A correction parameter is ascertained such that a second directional signal has a defined relative attenuation in the first direction. The second directional signal is generated from the forward signal and the backward signal with the first directional parameter and the correction parameter or with the first directional signal and the omnidirectional signal based on the correction parameter. An output signal of the hearing aid is generated based on the second directional signal.

23 Claims, 5 Drawing Sheets

(56) References Cited

U.S. PATENT DOCUMENTS

| | | | | |
|---|---|---|---|---|
| 8,666,090 | B1 | 3/2014 | Townsend | |
| 10,412,507 | B2 | 9/2019 | Fischer | |
| 10,659,890 | B2 | 5/2020 | Dressler et al. | |
| 2018/0310105 | A1* | 10/2018 | Dressler | H04R 25/505 |
| 2019/0075405 | A1* | 3/2019 | Fischer | H04R 25/405 |

FOREIGN PATENT DOCUMENTS

| | | | |
|---|---|---|---|
| EP | 2262285 | A1 | 12/2010 |
| EP | 3461147 | A1 | 3/2019 |
| WO | 2004057914 | A1 | 7/2004 |

* cited by examiner

METHOD FOR DIRECTIONAL SIGNAL PROCESSING FOR A HEARING AID

CROSS-REFERENCE TO RELATED APPLICATION

This application claims the priority, under 35 U.S.C. § 119, of German patent application DE 10 2019 211 943, filed Aug. 8, 2019; the prior application is herewith incorporated by reference in its entirety.

BACKGROUND OF THE INVENTION

Field of the Invention

The invention relates to a method for directional signal processing for a hearing aid, wherein a first input signal is generated by a first input transducer of the hearing aid from an ambient acoustic signal, i.e., an acoustic signal from the surroundings, wherein a second input signal is generated by a second input transducer of the hearing aid from the acoustic signal from the surroundings, wherein a first directional signal is generated on the basis of the first input signal and on the basis of the second input signal, the first directional signal having a maximum attenuation in a first direction, and wherein an output signal of the hearing aid is generated on the basis of the first directional signal.

In a hearing aid, ambient sound is converted into at least one input signal by means of at least one input transducer, the input signal being processed in frequency band-specific fashion on the basis of a hearing disorder of the wearer to be corrected and, in the process, in particular, in a manner individually adapted to the wearer, with the input signal also being amplified in the process. The processed signal is converted by way of an output transducer of the hearing aid into an acoustic output signal, which is guided to the ear of the wearer.

Here, hearing aids with two or more input transducers, in which two or more corresponding input signals are generated from the ambient sound for further processing, represent an advantageous development. This further processing of the input signals generally comprises directional signal processing, i.e., the formation of directional signals from the input signals, with the different directional effect usually being used to accentuate a given signal source—usually a speaker in the surroundings of the hearing aid wearer—and/or to suppress noise.

Here, particular importance is placed in so-called adaptive directional microphony, within which a directional signal is generated in such a way that it has a maximum attenuation in the direction of an assumed, localizable disturbance signal source. The assumption used to this end is usually that noises occurring from the region behind the wearer of the hearing aid, i.e., in their rear half space (i.e., rearward hemisphere), should be treated as disturbance noise as a matter of principle. On the basis of this assumption, conventional directional microphony algorithms usually minimize the signal energy from the rear half space in order to generate the directional signal with the desired attenuation properties. In the direction of maximum attenuation, the directional signal has, in particular, a so-called "notch", i.e., total ("infinite") attenuation. Consequently, the sound of the localized disturbance noise source is ideally completely masked from the directional signal.

However, the assumption that noise arriving from the rear half space should be considered to be disturbance noise only is not applicable in some cases, for example if the seated wearer of the hearing aid is spoken to from the side or from behind by another person. Additionally, certain noises from daily life, such as a siren of an emergency vehicle, must, as a consequence of their alerting effect for the hearing aid wearer, also be perceivable when they arrive from the wearer's rear half space.

BRIEF SUMMARY OF THE INVENTION

The invention is based on the object of specifying a method for signal processing for a hearing aid, by means of which there is no complete cancellation of potentially relevant acoustic signals from the non-frontal direction and, in particular, from the rear half space when directional microphony is applied.

With the above and other objects in view there is provided, in accordance with the invention, a method of directional signal processing for a hearing aid, the method comprising:

generating a first input signal by a first input transducer of the hearing aid from an ambient acoustic signal;

generating a second input signal by a second input transducer of the hearing aid from the ambient acoustic signal;

generating a forward signal and a backward signal from the first input signal and the second input signal;

determining a first directional parameter as a linear factor of a linear combination of the forward signal and the backward signal for forming a first directional signal from the linear combination having a maximum attenuation in a first direction;

ascertaining a correction parameter such that a second directional signal, being a linear combination formed from the first directional signal and an omnidirectional signal with the correction parameter, has a defined relative attenuation in the first direction;

generating the second directional signal from the forward signal and the backward signal on a basis of the first directional parameter and the correction parameter or from the first directional signal and the omnidirectional signal on a basis of the correction parameter; and generating an output signal of the hearing aid based on the second directional signal.

In other words, the objects of the objects of the invention are achieved by a method for directional signal processing for a hearing aid, wherein a first input signal is generated by a first input transducer of the hearing aid from an acoustic signal from the surroundings, wherein a second input signal is generated by a second input transducer of the hearing aid from the acoustic signal from the surroundings, wherein a forward signal and a backward signal are each generated from the first input signal and the second input signal, and wherein a first directional parameter is determined as a linear factor of a linear combination of the forward signal and the backward signal such that a first directional signal emerging from this linear combination has a maximum attenuation in a first direction. Here, provision is made for a correction parameter to be ascertained in such a way that a second directional signal, as a linear combination formed from the first directional signal and an omnidirectional signal with the correction parameter as a linear factor, has a defined attenuation in the first direction, wherein the second directional signal is generated from the forward signal and the backward signal on the basis of the first directional parameter and the correction parameter or from the first directional signal and the omnidirectional signal on the basis of the correction parameter, and wherein an output signal of the hearing aid is generated on the basis of the second directional signal, the output signal preferably being converted into an acoustic output signal by an output transducer of the hearing aid.

Advantageous embodiments, some of which are considered inventive on their own, are the subject matter of the dependent claims and of the following description.

Here, an input transducer comprises, in particular, an electroacoustic transducer, which is configured to generate a corresponding electrical signal from an acoustic signal. Preferably, there is also preprocessing, e.g., in the form of a linear pre-amplification and/or an A/D conversion, when generating the first and second input signal by the respective input transducer.

Generating the forward signal and the backward signal from the first and the second input signal preferably comprises the signal components of the first and the second input signal being included in the forward signal and in the backward signal and consequently, in particular, the first and the second input signal not both only being used at the same time to generate control parameters or the like, which are applied to signal components of other signals. Preferably, at least the signal components of the first input signal and, particularly preferably, also the signal components of the second input signal are included linearly in the forward signal and in the backward signal in this case. A comparable statement applies to generating the second directional signal on the basis of the forward signal and the backward signal, and optionally to further signals and their corresponding generation.

Here, a signal, such as, e.g., the second directional signal, can also be generated from the generating signals, such as, e.g., the forward signal and the backward signal, in such a way that, initially, one or more intermediate signals are formed from the generating signals within the scope of the signal processing, the generated signal (i.e., the second directional signal, for example) then being formed from the intermediate signals. Then, the signal components of the generating signals, i.e., the forward and backward signal in the present example, are initially included in the respective intermediate signal and the signal components of the respective intermediate signal are subsequently included in the generated signal, i.e., in the second directional signal in the present case, such that the signal components of the generating signals (i.e., of the forward and backward signal, for example) "are passed through" to the generated signal (i.e., the second directional signal, for example) via the respective intermediate signal and are amplified frequency band by frequency band when necessary in the process, are partly delayed with respect to one another or are differently weighted with respect to one another, etc.

Here, a forward signal comprises, in particular, a directional signal with a non-trivial directional characteristic, which, on average, has a greater sensitivity in relation to a standardized test sound at a given level in a front half space of the hearing aid than in a rear half space. Preferably, the direction of maximum sensitivity of the forward signal in this case is likewise located in the front half space, in particular in the forward direction (i.e., at 0° with respect to a preferred direction of the hearing aid), while a direction of minimum sensitivity of the forward signal is located in the rear half space, in particular in the backward direction (i.e., at 180° with respect to a preferred direction of the hearing aid). Preferably, a corresponding signal applies to the backward signal, if front and rear half space and forward and backward direction are interchanged. Here, the front and the rear half space and the forward and the backward direction of the hearing aid are preferably defined by a preferred direction of the hearing aid, which preferably coincides with the frontal direction of the wearer when they are wearing the hearing aid as intended. This should remain unaffected by deviations therefrom on account of an inaccurate adjustment during wear.

In particular, the forward and the backward signal are symmetric to one another with respect to a plane of symmetry that is perpendicular to the preferred direction. By way of example, the directional characteristic of the forward signal is given by a cardioid in an advantageous configuration, while the directional characteristic of the backward signal is given by an anti-cardioid in this configuration.

To determine the first directional parameter, it is not mandatory for the first directional signal to actually be generated for further signal processing of the signal components thereof. Rather, the first directional parameter a1 can be ascertained, for example by minimizing the signal energy of the linear combination Z1+a1·Z2 (with Z1 being the forward signal and Z2 being the backward signal) or by other processes of optimization or adaptive directional microphony, without the signal emerging from the linear combination, which corresponds to the first directional signal, finding any further use during the course of the remainder of the method. In this case, the second directional signal is generated directly from the forward signal and the backward signal. Here, the first directional parameter is set by the minimization of the signal energy or by other processes of optimization in such a way that the resultant first directional signal, even if it finds no further use, has the maximum attenuation in the first direction as required, particularly if this is specified by the direction of a dominant sound source.

Here, a maximum attenuation of the first directional signal should be understood to mean that, in particular, the relevant directional characteristic has a sensitivity which has a local minimum, preferably a global minimum, in the respective direction. Expressed differently, the first directional signal consequently has a non-trivial directional characteristic and consequently has a variable sensitivity in space in relation to a standardized test sound at a given level. Here, the first directional signal preferably has a "notch" with total or virtually total attenuation, i.e., by at least 15 dB, preferably by at least 20 dB, in the first direction. However, in contrast thereto, the omnidirectional signal preferably has an angle-independent sensitivity in relation to a standardized test sound.

Likewise, for the purposes of ascertaining the correction parameter, it is not mandatory for the second directional signal to actually be formed as a linear combination, in particular as a convex superposition of the first directional signal and the omnidirectional signal with the correction parameter as a linear factor or convexity parameter. Rather, the correction parameter is chosen in such a way that a second directional signal, generated as required, has the required defined relative attenuation in the first direction.

The actual generation of the second directional signal, the signal components of which are included in the output signal, is implemented here by way of, in particular, the described linear combination or convex superposition of the omnidirectional signal with the first directional signal on the basis of the correction parameter or, as an alternative thereto, by a linear combination of the forward signal and the backward signal.

Here, a convex superposition for the second directional signal R2 should be understood, in particular, as a superposition of the form $$R2=(1-e)\cdot om+e\cdot R1, \quad \text{(i)}$$

with the correction parameter e as convexity parameter, om as omnidirectional signal, and the first directional signal R1. In this case, the dependence of the second directional signal on the first directional parameter is implemented implicitly via the first directional signal.

In this case, the alternative generation of the second directional signal R2 from the forward signal Z1 and the backward signal Z2 on the basis of the correction parameter e and the first directional parameter in particular has the following form:

$$R2=Z1+a2\cdot Z2 \text{ where } a2=f(a1,e), \quad \text{(ii)}$$

where a2 is a second directional parameter that depends on the first directional parameter a1 and on the correction parameter e.

In the case of a suitable choice of the forward signal Z1 and the backward signal Z2, for example as cardioid and anti-cardioid signal, the omnidirectional signal om and the first directional signal R1 from equation (i) can also be represented on the basis of the forward and the backward signal (for the omnidirectional signal om) or can also be generated by means of adaptive directional microphony (for the first directional signal R1=Z1+a1·Z2). In this case, two mutually equivalent options or representations exist for the generation of the second directional signal R2, which are given by equations (i) and (ii).

The defined relative attenuation, which the second directional signal has in the first direction (the first directional signal has precisely the maximum attenuation in this direction), should be understood to mean that, in particular, the second directional signal has a sensitivity in the first direction that is less than the maximum sensitivity by a factor which is set by the correction parameter, in particular. Thus, in particular, the defined relative attenuation means an attenuation by a factor or in dB, which can preferably be specified immediately if the correction parameter is known.

By way of example, if the first direction lies in the rear half space at 120° (zero degrees in the frontal direction) and if the second directional signal is mixed in equal parts from the omnidirectional signal and the first directional signal, then this also sets the value of the relative attenuation of the second directional signal at 120°—i.e., in the first direction—in relation to a maximum sensitivity of the signals.

In the case where, for example, the second directional signal as per equation (i) is generated from the omnidirectional signal and the first directional signal or where, for an actual generation which, according to equation (ii), is implemented from the forward and the backward signal, there at least is a representation equivalent thereto as per equation (i), the correction parameter e immediately specifies the calculated proportion of the first directional signal in the second directional signal. Since its attenuation in the first direction is total, i.e., infinite, in the ideal case, the sensitivity of the second directional signal in the first direction is completely set by the component (1−e) of the omnidirectional signal om in the ideal case. By way of example, if a suppression by only 6 dB is desired in the first direction, the component of the omnidirectional signal in a second directional signal formed according to equation (i) (or in a second directional signal equivalent thereto) will be chosen as 50%, i.e., e=0.5, as a consequence of the complete suppression in the first direction by the first directional signal. Should the attenuation of the first directional signal in the first direction be finite, i.e., 15 dB or 20 dB, for example, the calculation can be adapted accordingly if the value of the attenuation in the first direction is known.

Here, the correction parameter is ascertained in particular on the basis of acoustic characteristics, which can be monitored on the basis of the two input signals or on the basis of signals derived from the input signals, such as, e.g., the forward and the backward signal, and in general on the basis of a signal characterizing the acoustic signal from the surroundings, and which have significance, in particular also quantifiable significance, in respect of the disturbance noise character of a non-frontal acoustic signal, i.e., in particular, also for an acoustic signal from the rear half space.

By way of example, such a significance can be given by a noise floor level, by a signal-to-noise ratio (SNR) or by a stationarity of the noise to be examined, wherein an examination of stationarity is preferably also accompanied by an examination in respect of the half space in which a dominant, non-frontal sound source is located.

Now, if the first directional signal is formed by means of adaptive directional microphony from the forward signal and the backward signal in such a way that the first direction—i.e., the direction of maximum attenuation of the first directional signal—is located in the direction of a dominant, localized sound source in the rear half space, the method can bring about a mixture with the omnidirectional signal in such a way that, as a result thereof, the resultant second directional signal is attenuated in the first direction by a defined factor; consequently, the sound of the sound source is no longer suppressed maximally or completely but remains audible to the wearer of the hearing aid.

By way of example, should it be determined on the basis of the backward signal that a substantially non-stationary signal is present there, which moreover has a significant sound level and lies significantly over the ascertained noise floor, i.e., a high SNR is furthermore present, this can be taken to be an indication for the dominant sound source being a speaker. In this case, mixing the omnidirectional signal with the first directional signal can be configured in such a way that a particularly high component of the former is included in the second directional signal in order not to suppress the signal contributions of this speaker speaking behind the wearer by the first directional signal. This applies, in particular, if the first directional signal is designed for dynamic or adaptive fitting of the first direction to the direction of such a dominant sound source.

On the other hand, if the SNR is rather low, it may, however, nevertheless be advantageous to not include too great a component of such a signal in the second directional signal as this could otherwise lead to an unwanted deterioration of the SNR of the second directional signal. By contrast, if a significantly stationary signal with a high SNR and a comparatively high level is present in the rear half space, the assumption can be made, for instance, that this is a localized disturbance noise. Accordingly, the component of the omnidirectional signal in the second directional signal can also be reduced here to the benefit of a better suppression of the disturbance noise, as implemented by the first directional signal.

In the limit case, the second directional signal can also be generated entirely without a further addition of signal components from the first directional signal in order to prevent a cancellation of a strongly directed sound source in the rear half space. Conversely, the second directional signal can also emerge entirely from the first directional signal, i.e., entirely without further addition of signal components of the omnidirectional signal, should a decision be made to suppress a directed acoustic signal from the rear half space to the best possible extent. In particular, these limit cases are formed by the end points of the value range of the correction parameter. Expressed differently, the second directional signal can thus be represented, in particular, by a mixture of the omnidirectional signal with the first directional signal (even if the specific generation of the signal may be implemented in different, yet equivalent fashion), with the mixture also comprising the limit cases where the signal components of one of the two generating signals are completely masked.

Expediently, the second directional signal is generated by a linear combination of the forward signal and the backward signal with a second directional parameter as a linear factor, wherein the second directional parameter is ascertained by a specified functional relationship from the first directional parameter and the correction parameter in such a way that the second directional signal has the defined relative attenuation in the first direction. By way of example, if the first directional signal R1 is ascertained from the forward signal and the backward signal Z1 and Z2, respectively, by way of adaptive directional microphony, i.e., in the form $$R1=Z1+a1\cdot Z2 \quad \text{(iii)}$$

with a1 as first directional parameter,
then the second directional signal R2 can be generated as $$R2=Z1+a2\cdot Z2 \text{ with } a2=f(a1,e)$$

as second directional parameter (cf. equation ii).

Preferably, the forward signal Z1 and the backward signal Z2 are generated symmetrically with respect to a preferred plane of the hearing aid (in particular, the frontal plane of the wearer) in this case, with the omnidirectional signal om particularly preferably also being reproducible by these signals, e.g., as om=Z1-Z2. In particular, Z1 is given by a cardioid and Z2 is given by an anti-cardioid in this case. This way of generating the second directional signal allows the generation to be carried out on the level of the forward and the backward signal, while the first directional signal R1 is only required for determining the first directional parameter a1 (on which the second directional parameter a2 of the second directional signal depends functionally as a2=f(a1, e) with a defined function f).

Expediently, the second directional parameter emerges here from the first directional parameter by way of a scaling by the correction parameter and by way of a specified offset. This means $$a2=f(a1,e)=e\cdot a1+d, \quad \text{(iv)}$$

with e<1 as correction parameter,
where the values for the correction parameter e and the offset d can be stored, for example, as tabulated values in the hearing aid in order to be able, depending on the first direction, to achieve a desired relative attenuation there by an appropriate parameter selection for e and d. As a result of the illustrated functional dependence of the second directional parameter on the first directional parameter, it is possible to particularly easily achieve a relative attenuation in the first direction, which is restricted to defined extent in the process. Preferably, the offset d is chosen as e−1 in the case where the forward and the backward signal are given by a cardioid and anti-cardioid signal, respectively.

It is also found to be advantageous if the second directional signal is generated by a convex superposition of the first directional signal and the omnidirectional signal with the correction parameter as a convexity parameter. Then, as a function of the omnidirectional signal om and the first directional signal R1, the second directional signal R2 is:

$$R2=(1-e)\cdot om+e\cdot R1 \quad \text{(cf. equation i),}$$

with the correction parameter e as convexity parameter. The latter is preferably ascertained on the basis of a noise floor level and/or an SNR and/or a stationarity of the acoustic signal from the surroundings.

Preferably, the forward signal and the backward signal are generated symmetrically with respect to a preferred plane of the hearing aid (in particular, the frontal plane of the wearer) in this case, by means of which signals the omnidirectional signal om is particularly preferably also reproducible, e.g., as om=Z1-Z2. In this case, the omnidirectional signal om and the first direction signal R1 can be represented by means of the forward and the backward signal Z1, Z2 in equation (i) above, specifically as $$R2=Z1+(e+e\cdot a1-1)\cdot Z2, \text{ and hence} \quad \text{(v)}$$

$$a2=(e+e\cdot a1-1) \quad \text{(vi)}$$

Here, it is evident from equation (vi) that the first directional parameter a1 is scaled by the factor e<1 and shifted by an offset of e−1. Preferably, the forward signal Z1 is given by a cardioid signal and the backward signal Z2 is given by an anti-cardioid signal in this case.

It was found to be further advantageous if a second direction is generated by swiveling the first direction about an angle tabulated on the basis of the correction parameter, wherein the second directional signal is generated by a linear combination of the forward signal and the backward signal with a second directional parameter as a linear factor and wherein the second directional parameter is ascertained in such a way that the second directional signal has a maximum attenuation in the second direction. This means the following: Initially, the first direction is ascertained, in which the first directional signal, formed preferably by means of adaptive directional microphony from the forward and the backward signal, has a maximum attenuation. Then, the correction parameter is ascertained, e.g., on the basis of a noise floor level, an SNR or a stationarity of the ambient acoustic signal (i.e., the acoustic signal from the surroundings).

Then, depending on the correction parameter and possibly the first direction itself, the first direction is shifted by a tabulated angle in such a way that the second directional signal, which is generated analogously to the first directional signal, has the maximum attenuation in the second direction, which emerges from the displacement of the first direction through the angle, and the defined relative attenuation in the first direction. Here, the second directional signal is generated by means of a preferably tabulated second directional parameter, which, in the case of the linear combination of the forward and the backward signal, precisely has the demanded attenuation properties for the second directional signal as a consequence.

Expediently the first directional parameter is generated by means of adaptive directional microphony with regard to the linear combination of the forward signal and the backward signal, in particular by minimizing the signal energy. This can particularly easily ensure that the first direction lies in the direction of a dominant sound source. A first directional signal thus generated finds use in many methods for directional noise suppression in hearing aids, and so the method described herein is particularly suitable for suppressing excessive or even complete cancellation of non-stationary sound sources, particularly in the rear half space of the wearer of the hearing aid.

Advantageously, the correction parameter is ascertained on the basis of at least one of the following variables characterizing the acoustic signal: a noise floor level and/or an SNR and/or a stationarity parameter and/or a directional information item. Preferably, the correction parameter is ascertained in such a way here that, for a comparatively high noise floor level or comparatively low SNR, the second directional signal emerges from a comparatively small correction of the first directional signal and, for a comparatively low noise floor level or comparatively high SNR, the second directional signal has a comparatively small directional effect. In particular, there can also be a step-wise application of the specified criteria in this case such that, e.g., the second directional signal still has a significant difference from the first directional signal for a high SNR, even in the case of a high noise floor level. Here, the noise floor level, the SNR and the stationarity parameter can be ascertained, in particular, on the basis of at least one of the two input signals or on the basis of the forward signal and/or the backward signal.

Expediently, the correction parameter is formed in this case by a monotonic function of the noise floor level which characterizes the acoustic signal, wherein the monotonic function, above an upper threshold, maps the noise floor level to a first end point of the value range of the correction parameter, at which the second directional signal transitions into the first directional signal. For the correction parameter $e \in [0, 1]$, the function of the noise floor level NP can be, e.g., in the form $$e=1 \text{ for } NP \geq Th_{Hi},$$

$$e=NP/Th_{Hi} \text{ for } NP<Th_{Hi}, \quad \text{(vii)}$$

with the upper threshold $Th_{Hi}$ for the noise floor level NP (in dB). A different functional dependence to the linear relation between e and NP shown in the second line of equation (vii) is likewise possible, providing the increase is monotonic in the case. In particular, it is also possible to specify a low threshold $Th_{Lo}$ for the noise floor level, below which e is set to be 0, i.e., for $NP \leq Th_{Lo}$. In this case, $e=(NP-Th_{Lo})/(Th_{Hi}-Th_{Lo})$ for $Th_{Lo}<NP<Th_{Hi}$.

Preferably, the monotonic function of the noise floor level which characterizes the acoustic signal is corrected in this case on the basis of the SNR and/or on the basis of the stationarity parameter in conjunction with the directional information item. By way of example, an option for such a correction consists of a function defined as per equation (vii)—possibly with a different functional, monotonic dependence for the range $NP<Th_{Hi}$ to the linear one specified therein—being reduced in its value range for e in the case of a sufficiently high SNR, i.e., for, for example, $SNR \geq Th_{SNR}$ with a correspondingly defined threshold $Th_{SNR}$ for the SNR, that is to say, for example, $$\text{for } SNR \geq Th_{SNR}: e \leq e_{max} \quad \text{(viii)}$$

with $e_{max}$ 0.7 or 0.5, for example, if the actual value range of e for $SNR<Th_{SNR}$ runs from 0 to 1. This means the following: For $SNR<Th_{SNR}$, e is determined according to the normal functional dependence of NP, e.g., according to equation (vii). For SNR $Th_{SNR}$, the value range of e is restricted at $e_{max}$ such that, in particular, the second directional signal, too, still has a significant difference from the first directional signal in this case if the second directional signal is generated as per equation (i).

A stationarity parameter finds use, in particular, within the scope of suppressing stationary disturbance noises and can consequently be taken from the latter and can alternatively also be ascertained by way of an autocorrelation function. Such a parameter usually has a value range between zero (completely non-stationary) and one (completely stationary). If such a stationarity parameter S1 now lies below a corresponding threshold, i.e., $S1 \leq Th_S$, and if it is possible on the basis of the directional information item to identify that the corresponding noise predominantly comes from the rear half space, the monotonic function which maps the noise floor level to the correction parameter can be corrected by choosing the gradient of the monotonic function to be flatter in a mid-range for the correction parameter, i.e., for example, for $0.4 \leq e \leq 0.6$, preferably also for $0.25 \leq e \leq 0.27$. In particular, such a correction can be combined with a correction according to equation (viii), continuously in e where possible.

It was found to be further advantageous if, in a defined neighborhood of a second end point of the value range of the correction parameter, a third directional signal is superposed on the second directional signal, the third directional signal being designed to simulate a natural directional effect of a human ear, and wherein the superposition transitions into the third directional signal when the correction parameter adopts the second end point of its value range. By way of example, this means that for $e \leq M$, with $M=0.1$ (a different value, e.g., 0.05, is possible), an output signal out is formed as follows:

$$out=(e/M)\cdot R2+[(M-e)/M]\cdot R3. \quad \text{(xi)}$$

At a second end of the value range of the correction parameter, which preferably corresponds to the region for which the second directional signal has the smallest possible component of the first directional signal or has the smallest possible directional effect, the second directional signal is thus increasingly superposed by the third directional signal and preferably completely merges into the third directional signal at the second end point for the correction parameter. As a result of this, the wearer of the hearing aid has the natural spatial hearing impression caused by a pinna for someone with normal hearing. In particular, this can be implemented since the assumption is made in this range for the correction parameter that the noise floor level is sufficiently low and/or the SNR sufficiently high.

Preferably, the forward signal is generated on the basis of a time delayed superposition, implemented by means of a first delay parameter, of the first input signal with the second input signal and/or wherein the backward signal is generated on the basis of a time delayed superposition, implemented by means of a second delay parameter, of the second input signal with the first input signal. In particular, the first and second delay parameter can be chosen to be identical to one another in this case and, in particular, the forward signal can be generated in symmetric fashion to the backward signal with respect to a preferred plane of the hearing aid, the preferred plane being assigned to the frontal plane of the wearer, preferably when wearing the hearing aid. Aligning the first directional signal to the frontal direction of the wearer simplifies the signal processing since this takes account of the natural viewing direction of the wearer.

Here, it was found to be advantageous if the forward signal is generated as a forwardly directed cardioid directional signal and the backward signal is generated as a backwardly directed cardioid directional signal (anti-cardioid). A cardioid directional signal can be formed by virtue of the two input signals being superposed on one another with the acoustic time-of-flight delay corresponding to the spacing of the input transducers. As a result of this, the direction of the maximum attenuation lies—depending on the sign of this time-of-flight delay during the superposition—in the frontal direction (backwardly directed cardioid directional signal) or in the opposite direction thereto (forwardly directed cardioid directional signal).

The direction of the maximum sensitivity is opposite to the direction of maximum attenuation. This simplifies the further signal processing since such an intermediate signal is particularly suitable for adaptive directional microphony as a consequence of the maximum attenuation in, or counter to, the frontal direction. Moreover, the omnidirectional signal can be represented or reproduced by way of a difference between the forwardly directed cardioid directional signal and the backwardly directed cardioid directional signal, and so the method can run on the level of the cardioid and anti-cardioid signals and the first directional signal is only generated for determining the corresponding adaptive directional parameter.

Expediently, the first directional signal is generated by means of adaptive directional microphony. What this can particularly easily achieve is that the first direction, in which the first directional signal has the maximum attenuation, coincides with a direction of a dominant sound source located in the rear half space.

In an advantageous embodiment, a first directional parameter is ascertained when generating the first directional signal, the first directional parameter characterizing a superposition of the first intermediate signal with the second intermediate signal for generating the first directional signal, wherein the second directional signal is generated by a superposition of the first intermediate signal with the second intermediate signal, which is characterized by a second directional parameter, and wherein the second directional parameter is ascertained on the basis of the first directional parameter in such a way that the second directional signal has, in the first direction, a relative attenuation that is defined in relation to the maximum sensitivity.

The invention further specifies a hearing system comprising a hearing aid which comprises a first input transducer for generating a first input signal from an acoustic signal from the surroundings and a second input transducer for generating a second input signal from the acoustic signal from the surroundings and comprising a control unit configured to carry out the method, as outlined above. In particular, the control unit can be integrated in the hearing aid. In this case, the hearing system is directly provided by the hearing aid. The hearing system shares the advantages of the method according to the invention. The advantages specified for the method and its developments can be transferred in analogous fashion to the hearing system in this case.

Other features which are considered as characteristic for the invention are set forth in the appended claims.

Although the invention is illustrated and described herein as embodied in a method for directional signal processing for a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

Mutually corresponding parts and variables are respectively provided with identical reference signs and numerals throughout the figures.

DETAILED DESCRIPTION OF THE INVENTION

Figure 1:
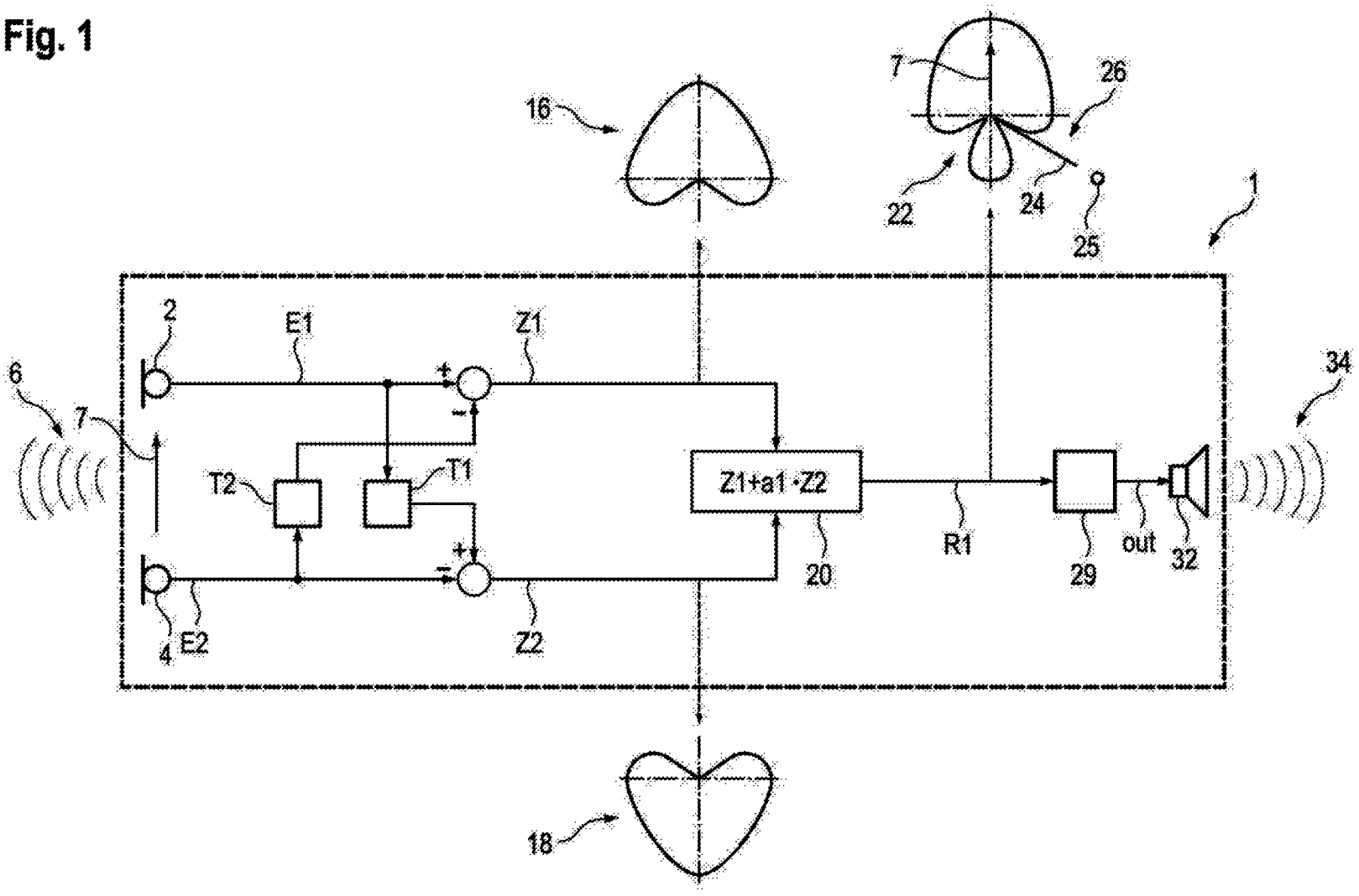
FIG. 1 shows a block diagram of a hearing aid according to the prior art, in which a directional signal with a maximum attenuation in a first direction is generated by means of adaptive directional microphony.

Referring now to the figures of the drawing in detail and first, in particular, to FIG. 1 thereof, there is shown a schematic block diagram of a method for directional signal processing in a hearing aid 1 according to the prior art. The hearing aid 1 has a first input transducer 2 and a second input transducer 4, which generate a first input signal E1 and a second input signal E2, respectively, from an acoustic signal 6 that is injected from the surroundings, i.e., an ambient acoustic signal 6. Each of the input transducers 2, 4 may be a microphone, for example. Here, in respect of a frontal direction 7 of the hearing aid 1 (which is defined by the intended wear during operation), the first input transducer 2 is disposed further forward than the second input transducer 4.

The second input signal E2 is now delayed by a first delay parameter T1 and the second input signal, thus delayed, is subtracted from the first input signal E1 in order to generate a forward signal Z1. In a similar fashion, the first input signal E1 is delayed by a second delay parameter T2 and the second input signal E2 is subtracted from the first input signal, thus delayed, in order to generate a backward (i.e., rearward) signal Z2. Here, apart from possible quantification errors during the digitization, the first delay parameter T1 and the second delay parameter T2 are given by the time-of-flight T, which precisely corresponds to the spatial acoustic path d between the first input transducer 2 and the second input transducer 4. Consequently, the forward signal Z1 is given by a forwardly directed cardioid signal 16 and the backward signal Z2 is given by a rearwardly directed cardioid signal 18 (i.e., an anti-cardioid).

A first directional signal R1 is obtained by way of adaptive directional microphony 20 from the forward signal Z1 and the backward signal Z2 by way of minimizing the signal energy of the signal Z1+a1·Z2 over a first directional parameter a1. Here, the first directional signal R1 has a directional characteristic 22 with a maximum attenuation in a first direction 24. As a consequence of choosing the first directional parameter a1 by means of the adaptive directional microphony 20, the first direction 24 coincides with the direction of a dominant, localized sound source 25 in the rear half space 26. In the example illustrated in FIG. 1, the first direction is twisted through about 120° with respect to the frontal direction 7, which coincides with a frontal direction of the wearer of the hearing aid 1 (not illustrated) when the hearing aid 1 is worn as intended. Here, a maximum attenuation means that the sound coming from the first direction 24 is completely canceled (i.e., "infinitely" attenuated) in the ideal case. In other words, the first directional signal 1 has a so-called "notch" in the first direction 24.

An output signal out, which is converted into an acoustic output signal 34 by an output transducer 32 of the hearing aid 1, is now generated from the signal contributions of the first directional signal R1, and possibly by way of even further non-directional signal processing 29. In the present case, the output transducer 32 may be a loudspeaker or else a bone conduction receiver.

If the dominant sound source 25 in the rear half space 26 (i.e., the rear hemisphere) originates from a speaker, for example, the presently implemented, maximum attenuation of their speech contributions may often not be desirable for the wearer of the hearing aid 1. In this case, it would be advantageous to use an output signal out with a directional characteristic that has no maximum attenuation in the first direction 24.

A corresponding method which can achieve this objective is illustrated with reference to FIG. 2. A block diagram shows a hearing aid 1 which is the same as the hearing aid according to FIG. 1 up to the point of generation of the first directional signal R1. Now, in the example according to FIG. 2, an omnidirectional signal om is formed on the basis of the forward signal Z1 and the backward signal Z2. The omnidirectional signal is superposed on the first directional signal R1 according to a specification yet to be described. This superposition is implemented according to the stipulation of a correction parameter e, which can be ascertained on the basis of the noise floor level NP and the SNR of the acoustic signal 6; however, it can moreover also be ascertained on the basis of a stationarity parameter S1 and a direction information item IR for the acoustic signal 6. Here, the variables can be ascertained either from the input signals E1 and E2 or from the forward and the backward signal Z1, Z2.

A second directional signal R2 emerges from the superposition according to $$R2=(1-e)\cdot om+e\cdot R1 \qquad \text{(cf. equation i).}$$

On the basis of the second directional signal R2, possibly also on the basis of further, non-directional signal processing 29 which may comprise, inter alia, a frequency band-dependent amplification and/or compression, the output signal out is generated in a manner analogous to the procedure illustrated in FIG. 1, the output signal being converted by the output transducer 32 into the acoustic output signal 34. Now, the directional characteristic 38 of the second directional signal R2 has its maximum attenuation along a second direction 40, whereas there is a relative attenuation 42 in the first direction 24.

Figure 2:
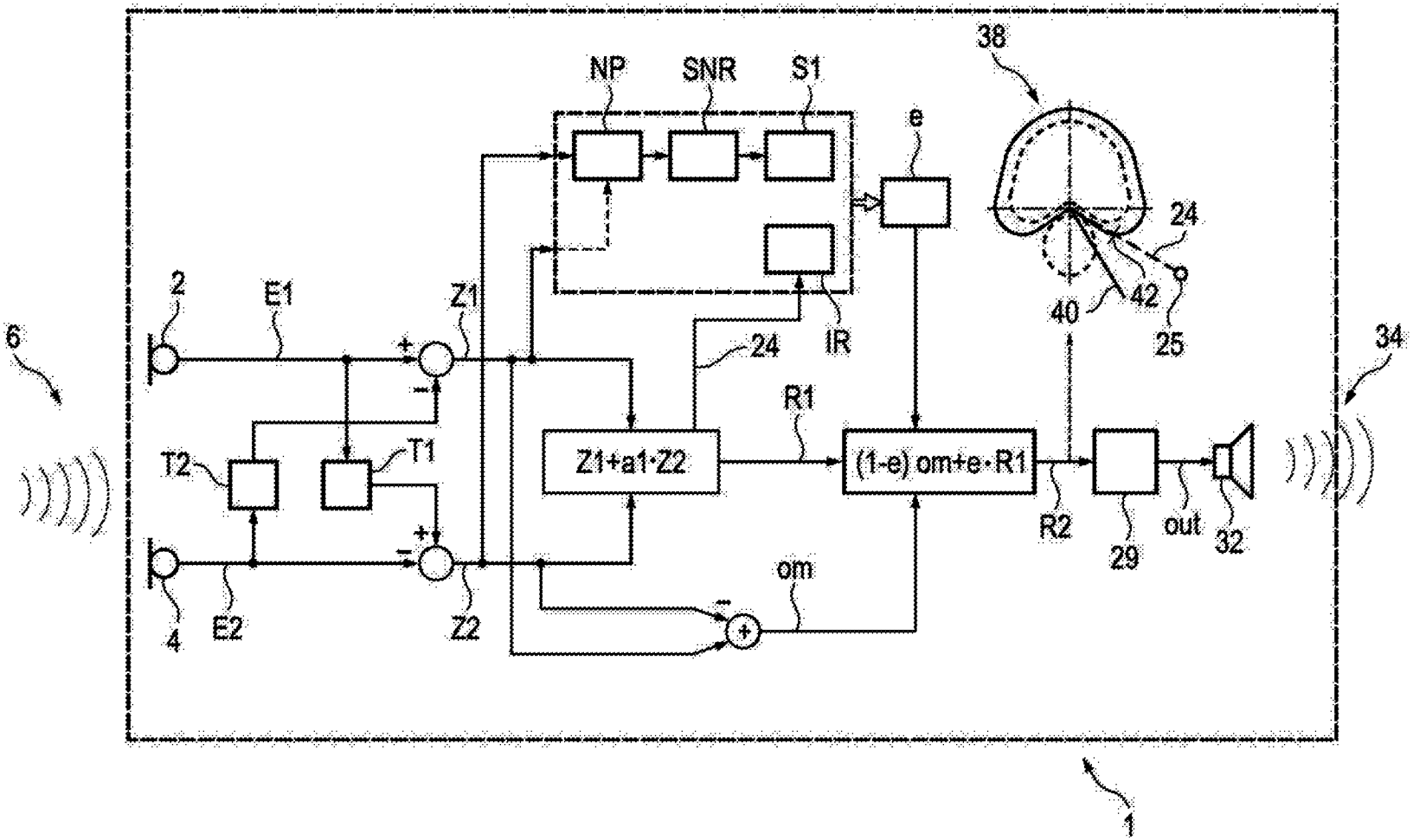
FIG. 2 shows a block diagram of a development according to the invention of the hearing aid of FIG. 1, wherein the attenuation is reduced in defined fashion in the first direction.
Figure 3:
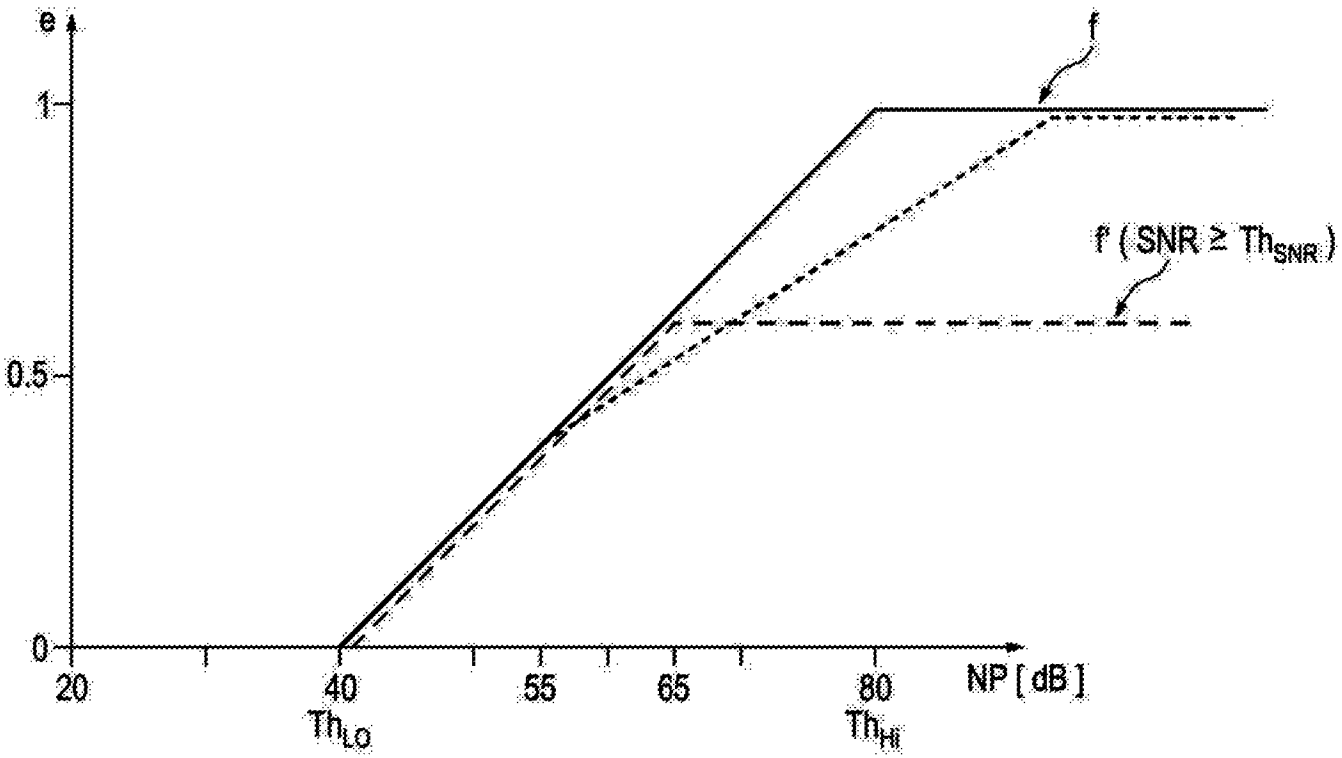
FIG. 3 shows a functional diagram of a correction parameter for reducing the attenuation as per FIG. 2 on the basis of a noise floor level.

FIG. 3 illustrates a function f which maps the noise floor level NP on the correction parameter e of the method illustrated on the basis of FIG. 2 (solid line). Above an upper threshold $Th_{Hi}$, which is chosen as $Th_{Hi}$=80 dB in the example as per FIG. 3, any floor noise level is mapped to e=1. This means the following: In the method illustrated in FIG. 2, the first directional signal R1 is completely converted into the second directional signal R2 for a noise floor level NP of 80 dB and more. Below a lower threshold $Th_{Lo}$, which is chosen as $Th_{Lo}$=40 dB in the example as per FIG. 3, any floor noise level is mapped to e=0. This means the following: In the method illustrated in FIG. 2, the omnidirectional signal om is completely converted into the second directional signal R2 for a noise floor level NP of 40 dB and less. In the range $Th_{Lo}<NP<Th_{Hi}$, the function f has a linear gradient, which can be described by $$e=f(NP)=(NP-Th_{Lo})/(Th_{Hi}-Th_{Lo}).$$

A different characteristic to the linear relation illustrated here is likewise conceivable, as long as the monotonic gradient for f(NP) is maintained between $Th_{Lo}$ and $Th_{Hi}$.

If the SNR now lies above a specified threshold $Th_{SNR}$, i.e., $SNR \geq Th_{SNR}$, the characteristic provided by the function f(NP) is capped, a new function f' (dashed line) emerging therefrom. In this case, this means the following: If the SNR is above $Th_{SNR}$, the behavior is identical to the original function f for comparatively low values of the noise floor level NP. However, above approximately NP=65 dB, e is always mapped to the value e=0.675. This takes account of the fact that, in the case of a high SNR, the directional noise suppression need not be completely implemented even in the case of a high noise floor level NP, and a greater component of the omnidirectional signal om can remain mixed in for reasons of the improved spatial hearing perception.

Should it moreover be determined that the acoustic signal 6 is firstly sufficiently non-stationary—e.g., on account of dropping below an upper limit $Th_S$ by the stationarity parameter S1—and moreover has a significant component originating from the rear half space (which is identified on the basis of the direction information item IR, which, for example, specifies the half space of the first direction 24 emerging from the adaptive directional microphony 20), the gradient of the function f is reduced in a range above 55 dB for the noise floor level NP (dotted line), as a result of which e=1 is only reached for a noise floor level NP above the threshold $Th_{Hi}$ (under the assumption $SNR<Th_{SNR}$ because otherwise the function f' is immediately applied).

Figure 4:
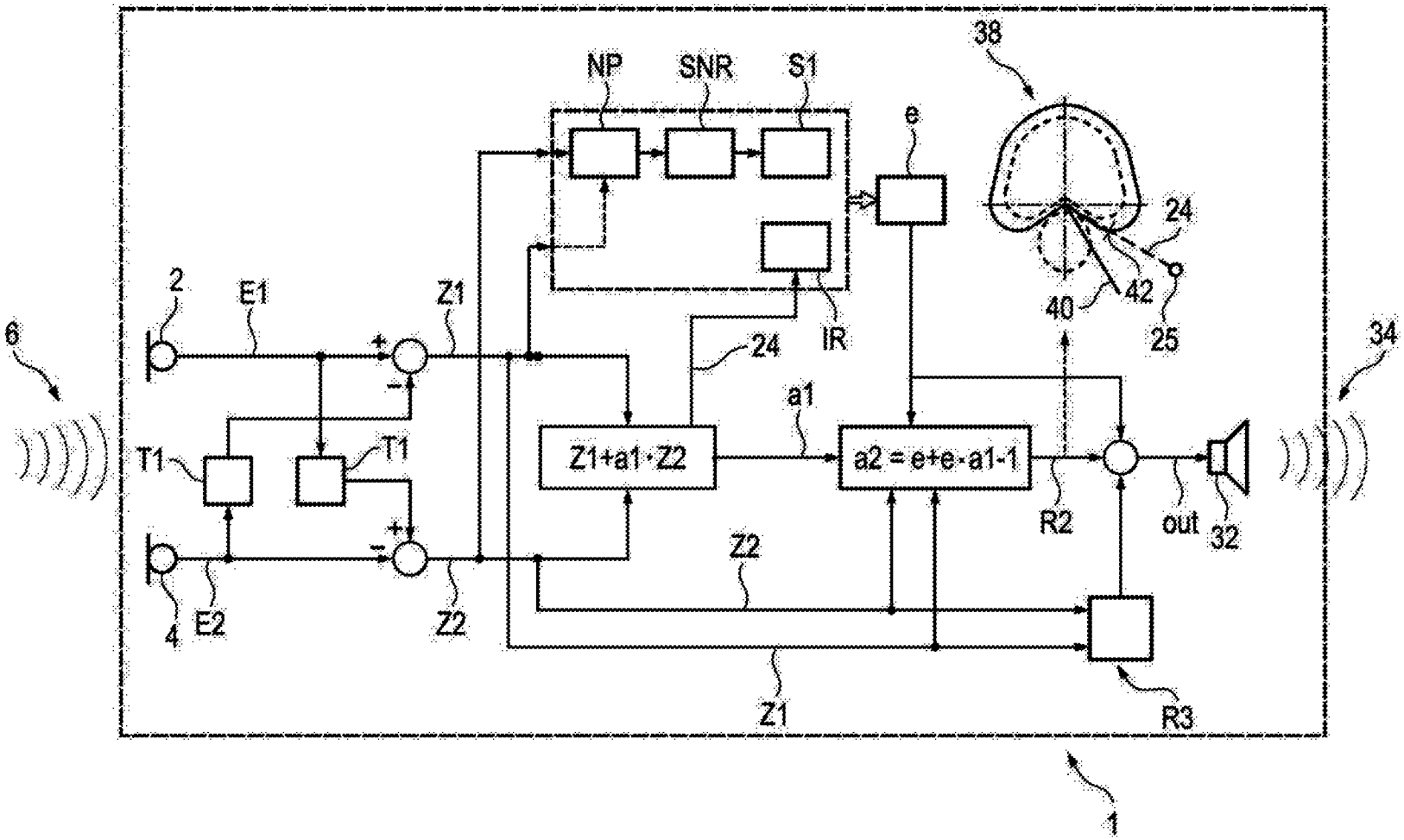
FIG. 4 shows a block diagram of an alternative configuration of the hearing aid according to FIG. 2.

A procedure analogous to the method explained on the basis of FIG. 2 is illustrated in FIG. 4. In a block diagram, the latter shows a hearing aid 1, which is modeled on the hearing aid 1 illustrated in FIG. 2. However, in this case, the second directional signal R2 is not formed as a superposition of the first directional signal R1 with the omnidirectional signal om according to the correction parameter e as a convexity parameter. Rather, the first directional parameter a1, which emerges from the generation of the first directional signal R1 by the adaptive directional microphony 20, is mapped as per the specification $$a2=e+e\cdot a1-1 \qquad \text{(cf. equation vi)}$$

on a second directional parameter a2, which is formed by scaling of the first directional parameter a1 by the factor e (the convexity parameter as per FIG. 2) and by shifting by the offset e−1. The second directional signal R2 is formed, in a manner analogous to the first directional signal R1, from the forward signal Z1 and the backward signal Z2 as $$R2=Z1+a2\cdot Z2 \qquad \text{(cf. equations v and vi).}$$

The directional characteristic 38 is accordingly equal to the directional characteristic of the second directional signal R2 according to FIG. 2 since, under the same conditions, the procedure illustrated in FIG. 4 is analogous to the procedure illustrated in FIG. 2, apart from an expansion for e≤0.1, which is described below. The maximum attenuation is now implemented in a second direction 40, while a defined relative attenuation 42 is present in the first direction 24.

In the case that a value in the vicinity of zero emerges from the calculation of the correction parameter e as per FIG. 3, i.e., e smaller than a specified threshold $e_{Lo}$=M with, e.g., M=0.1, the output signal out is generated by virtue of a third directional signal R3 being mixed to the second directional signal R2, for example according to the following formula:

$$out=(e/M)\cdot R2+[(M-e)/M]\cdot R3 \qquad \text{(cf. equation xi).}$$

Here, the third directional signal R3 is generated with a fixed directional characteristic from the forward signal Z1 and the backward signal Z2. Alternative transitions between R2 and R3, which do not have the aforementioned linear relationship in e, are likewise conceivable.

Figure 5:
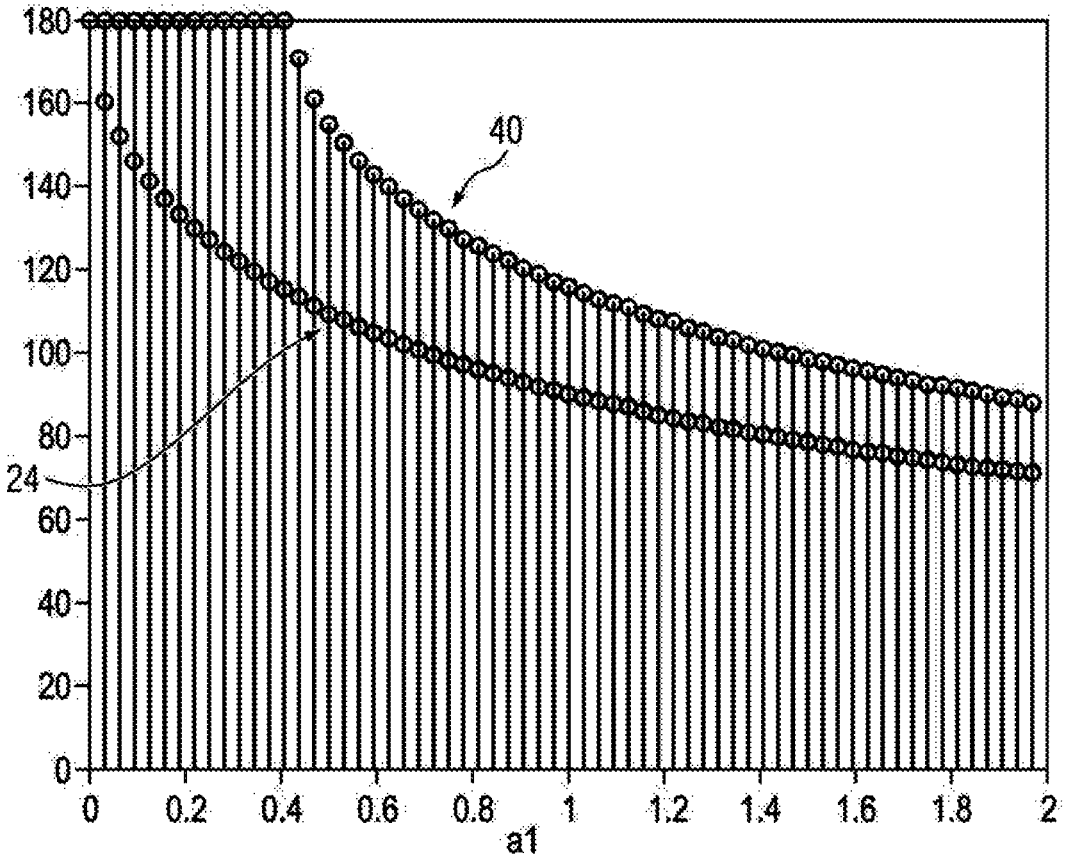
FIG. 5 shows a diagram of the direction of maximum attenuation for a first directional signal and a directional signal developed as per FIG. 2 or FIG. 4, as a function of the directional parameter.

FIG. 5 schematically shows, in a diagram, the relationship between the first directional parameter a1, which characterizes the first directional signal R1, and the second directional parameter a2 of the second directional signal R2 according to FIG. 4. Here, the functional relationship is a2=0.7·a1−0.3. In the example illustrated in FIG. 5, the lower symbols are formed by the respective first direction 24 with respect to the parameter value of the first directional parameter a1, while the upper symbols are given by the second direction with respect to the given parameter value for a1, i.e., by the angle to which, in the second directional signal R2, the second direction 40, i.e., the direction of maximum attenuation after applying the mapping of the first directional parameter R1 on the second directional parameter a2, adjusts. In respect of a given value of a1, it is possible to determine that the angle increases, wherein, as a consequence of the axial symmetry of the directional characteristics with respect to the frontal direction, there is clipping in the angle direction of 180°, which is counter to the frontal direction. As a result of the shown swiveling of the direction of maximum attenuation during the transition from the first to the second directional signal, a relative attenuation, defined in relation to the maximum sensitivity and controlled by the correction parameter e, emerges in the first direction, which still had the maximum attenuation in the first directional signal.

Even though the invention was illustrated more closely and described in detail by way of the preferred exemplary embodiment, the invention is not restricted by the disclosed examples and other variations can be derived therefrom by a person skilled in the art without departing from the scope of protection of the invention.

The following is a summary list of reference numerals and the corresponding structure used in the above description of the invention:

1 Hearing aid
2 First input transducer
4 Second input transducer
6 Ambient acoustic signal, acoustic signal of the surroundings
7 Frontal direction
16 Forwardly directed cardioid (signal)
18 Backwardly directed cardioid (signal)
20 Adaptive directional microphony
22 Directional characteristic
24 First direction
25 Dominant sound source
26 Rear half space
29 Non-directional signal processing
32 Output transducer
34 Acoustic output signal
38 Directional characteristic
40 Second direction
42 Relative attenuation
a1 First directional parameter
a2 Second directional parameter
e Correction parameter
E1 First input signal
E2 Second input signal
IR Directional information item
om Omnidirectional signal
out Output signal
NP Noise floor level
R1 First directional signal
R2 Second directional signal
R3 Third directional signal
S1 Stationarity parameter
SNR Signal-to-noise ratio
$Th_{Lo}$ Lower threshold (for the noise floor level NP)
$Th_{Hi}$ Upper threshold (for the noise floor level NP)
$Th_S$ Upper threshold (for the SNR)
Z1 Forward signal
Z2 Backward signal

The invention claimed is:

1. A method of directional signal processing for a hearing aid, the method comprising:
   - generating a first input signal by a first input transducer of the hearing aid from an ambient acoustic signal;
   - generating a second input signal by a second input transducer of the hearing aid from the ambient acoustic signal;
   - generating a forward signal and a backward signal from the first input signal and the second input signal;
   - determining a first directional parameter as a linear factor of a linear combination of the forward signal and the backward signal for forming a first directional signal from the linear combination having a maximum attenuation in a first direction;
   - ascertaining a correction parameter such that a second directional signal, being a linear combination formed from the first directional signal and an omnidirectional signal with the correction parameter, has a defined relative attenuation in the first direction;
   - generating the second directional signal from the forward signal and the backward signal on a basis of the first directional parameter and the correction parameter, the second directional signal being generated by a linear combination of the forward signal and the backward signal, with a second directional parameter as a linear factor;
   - ascertaining the second directional parameter by a specified functional relationship from the first directional parameter and the correction parameter such that the second directional signal has the defined relative attenuation in the first direction; and
   - generating an output signal of the hearing aid based on the second directional signal.

2. The method according to claim 1, wherein the second directional parameter emerges from the first directional parameter by way of a scaling by the correction parameter and by way of a specified offset.

3. The method according to claim 1, wherein the first directional parameter is generated by adaptive directional microphony with regard to the linear combination of the forward signal and the backward signal.

4. The method according to claim 3, wherein the step of generating the first direction parameter comprises minimizing a signal energy.

5. The method according to claim 4, which comprises ascertaining the correction parameter based on at least one variable characterizing the acoustic signal selected from the group consisting of: a noise floor level, a signal-to-noise ratio, a stationarity parameter, and a directional information item.

6. The method according to claim 5, which comprises forming the correction parameter by a monotonic function of the noise floor level which characterizes the acoustic signal, wherein the monotonic function, above an upper threshold, maps the noise floor level to a first end point of the value range of the correction parameter, at which the second directional signal transitions into the first directional signal.

7. The method according to claim 6, which comprises correcting the monotonic function of the noise floor level which characterizes the acoustic signal based on the signal-to-noise ratio and/or based on a stationarity parameter in conjunction with a directional information item.

8. The method according to claim 1, which comprises:

within a defined neighborhood of a second end point of a value range of the correction parameter, effecting a superposition of a third directional signal on the second directional signal, the third directional signal being configured to simulate a natural directional effect of a human ear; and transitioning the superposition into the third directional signal when the correction parameter adopts the second end point of the value range of the correction parameter.

9. The method according to claim 1, which comprises:

generating the forward signal on a basis of a time delayed superposition, implemented by way of a first delay parameter, of the first input signal with the second input signal; and/or generating the backward signal on a basis of a time delayed superposition, implemented by way of a second delay parameter, of the second input signal with the first input signal.

10. The method according to claim 9, which comprises:

generating the forward signal as a forwardly directed cardioid directional signal; and generating the backward signal as a backwardly directed cardioid directional signal.

11. A hearing system, comprising a hearing aid having a first input transducer for generating a first input signal from an ambient acoustic signal and a second input transducer for generating a second input signal from the ambient acoustic signal; and a control unit configured to carry out the method according to claim 1.

12. A method of directional signal processing for a hearing aid, the method comprising:

generating a first input signal by a first input transducer of the hearing aid from an ambient acoustic signal;

generating a second input signal by a second input transducer of the hearing aid from the ambient acoustic signal;

generating a forward signal and a backward signal from the first input signal and the second input signal;

determining a first directional parameter as a linear factor of a linear combination of the forward signal and the backward signal for forming a first directional signal from the linear combination having a maximum attenuation in a first direction;

ascertaining a correction parameter such that a second directional signal, being a linear combination formed from the first directional signal and an omnidirectional signal with the correction parameter, has a defined relative attenuation in the first direction;

generating the second directional signal from the forward signal and the backward signal from the first directional signal and the omnidirectional signal on a basis of the correction parameter, the second directional signal being generated by a convex superposition of the first directional signal and the omnidirectional signal, with the correction parameter as a convexity parameter; and generating an output signal of the hearing aid based on the second directional signal.

13. The method according to claim 12, wherein the first directional parameter is generated by adaptive directional microphony with regard to the linear combination of the forward signal and the backward signal.

14. The method according to claim 13, wherein the step of generating the first direction parameter comprises minimizing a signal energy.

15. The method according to claim 14, which comprises ascertaining the correction parameter based on at least one variable characterizing the acoustic signal selected from the group consisting of: a noise floor level, a signal-to-noise ratio, a stationarity parameter, and a directional information item.

16. The method according to claim 15, which comprises forming the correction parameter by a monotonic function of the noise floor level which characterizes the acoustic signal, wherein the monotonic function, above an upper threshold, maps the noise floor level to a first end point of the value range of the correction parameter, at which the second directional signal transitions into the first directional signal.

17. The method according to claim 16, which comprises correcting the monotonic function of the noise floor level which characterizes the acoustic signal based on the signal-to-noise ratio and/or based on a stationarity parameter in conjunction with a directional information item.

18. A method of directional signal processing for a hearing aid, the method comprising:

generating a first input signal by a first input transducer of the hearing aid from an ambient acoustic signal;

generating a second input signal by a second input transducer of the hearing aid from the ambient acoustic signal;

generating a forward signal and a backward signal from the first input signal and the second input signal;

determining a first directional parameter as a linear factor of a linear combination of the forward signal and the backward signal for forming a first directional signal from the linear combination having a maximum attenuation in a first direction;

ascertaining a correction parameter such that a second directional signal, being a linear combination formed from the first directional signal and an omnidirectional signal with the correction parameter, has a defined relative attenuation in the first direction;

generating a second direction by swiveling the first direction about an angle tabulated on a basis of the correction parameter;

generating the second directional signal from the forward signal and the backward signal on a basis of the first directional parameter and the correction parameter, the second directional signal being generated by a linear combination of the forward signal and the backward signal with a second directional parameter as a linear factor; and ascertaining the second directional parameter to form the second directional signal with a maximum attenuation in the second direction; and generating an output signal of the hearing aid based on the second directional signal.

19. The method according to claim 18, wherein the first directional parameter is generated by adaptive directional microphony with regard to the linear combination of the forward signal and the backward signal.

20. The method according to claim 19, wherein the step of generating the first direction parameter comprises minimizing a signal energy.

21. The method according to claim 20, which comprises ascertaining the correction parameter based on at least one variable characterizing the acoustic signal selected from the group consisting of: a noise floor level, a signal-to-noise ratio, a stationarity parameter, and a directional information item.

22. The method according to claim 21, which comprises forming the correction parameter by a monotonic function of the noise floor level which characterizes the acoustic signal, wherein the monotonic function, above an upper threshold, maps the noise floor level to a first end point of the value range of the correction parameter, at which the second directional signal transitions into the first directional signal.

23. The method according to claim 22, which comprises correcting the monotonic function of the noise floor level which characterizes the acoustic signal based on the signal-to-noise ratio and/or based on a stationarity parameter in conjunction with a directional information item.

* * * * *